US006260558B1

(12) United States Patent
Neuner

(10) Patent No.: US 6,260,558 B1
(45) Date of Patent: Jul. 17, 2001

(54) FLOCKED RING MASCARA APPLICATOR AND METHOD OF MAKING THE SAME

(75) Inventor: Charles P. Neuner, Amityville, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/621,794

(22) Filed: Jul. 21, 2000

(51) Int. Cl.[7] ..... A45D 40/26; A46B 11/00

(52) U.S. Cl. ..... 132/218; 132/320; 401/129; 401/122

(58) Field of Search ..... 132/218, 313, 132/317, 320; 401/122, 129, 126, 127, 128; 15/206, 207

(56) References Cited

U.S. PATENT DOCUMENTS

| | | | | |
|---|---|---|---|---|
| 3,896,823 | | 7/1975 | Spatz | 132/88.7 |
| 3,998,235 | | 12/1976 | Kingsford | 132/88.5 |
| 4,404,977 | | 9/1983 | Vasas | 132/88.7 |
| 4,411,282 | | 10/1983 | Wavering | 132/88.5 |
| 4,422,986 | | 12/1983 | Cole | 264/39 |
| 4,446,880 | | 5/1984 | Gueret et al. | 132/88.5 |
| 4,527,575 | | 7/1985 | Vasas | 132/88.7 |
| 4,572,224 | | 2/1986 | Rosenwinkel et al. | 132/88.5 |
| 4,632,136 | | 12/1986 | Kingsford | 132/88.7 |
| 4,635,659 | * | 1/1987 | Spatz | 132/218 |
| 4,733,425 | | 3/1988 | Hartel et al. | 15/206 |
| 4,861,179 | | 8/1989 | Schrepf et al. | 401/129 |
| 4,887,622 | | 12/1989 | Gueret | 132/320 |
| 4,898,193 | | 2/1990 | Gueret | 132/218 |
| 4,927,281 | | 5/1990 | Gueret | 401/129 |
| 4,974,612 | | 12/1990 | Gueret | 132/218 |
| 4,993,440 | | 2/1991 | Gueret | 132/218 |
| 5,197,497 | | 3/1993 | Gueret | 132/218 |
| 5,238,011 | | 8/1993 | Gueret | 132/218 |
| 5,370,141 | | 12/1994 | Gueret | 132/218 |
| 5,542,439 | | 8/1996 | Gueret | 132/218 |
| 5,588,450 | | 12/1996 | Gueret | 132/218 |
| 5,722,436 | * | 3/1998 | Vandromme et al. | 132/218 |
| 5,816,728 | | 10/1998 | Nardolillo et al. | 401/126 |

* cited by examiner

*Primary Examiner*—John J. Wilson
*Assistant Examiner*—Robyn Kieu Doan
(74) *Attorney, Agent, or Firm*—Kenyon & Kenyon

(57) ABSTRACT

A brush-type cosmetics applicator is provided that has bristle characteristics that vary at regular intervals along the length of the applicator. A plurality of annular members (e.g., disks, sleeves, rings, beads, etc.) are each individually formed by, for example, molding. Each annular member has a central bore. At least some of the plurality of annual members are flocked, preferably on an outwardly directed surface, with fibers of a desired diameter, hardness, flexibility, length and composition (material). The remaining annular members may not be flocked, or may be flocked with fibers having one or more characteristics different from the fibers used on the first group, e.g., a different diameter, hardness, flexibility, length or composition, or a combination thereof. Alternatively, each annular member of the second group may be flocked on a surface different from the surface flocked on each annular member of the first group. As another alternative, each annular member of the second group, whether flocked with the same or different fibers, or not flocked, may have a radial or axial dimension that is different from the annual members of the first group. Annular members from each group are arranged consecutively by way of the bore in each annular member on a shaft or pin to form the applicator portion of an applicator. The annular members are arranged in sequences that yield the desired applicator characteristics. For example, annular members from the first group may be provided with long bristles and be alternated with annular members from the second group provided with shorter bristles to form a brush-type applicator with improved coating and combing abilities.

22 Claims, 2 Drawing Sheets

FLOCKED RING MASCARA APPLICATOR AND METHOD OF MAKING THE SAME

FIELD OF THE INVENTION

The present invention relates to a brush-type applicator with fibers extending from a core. More particularly, the invention concerns a brush-type cosmetic applicator with a core made from stacked annular members, each annular member having fibers extending from a surface, and method of making the applicator.

DESCRIPTION OF THE PRIOR ART

The conventional purpose of a mascara brush is to apply mascara to a user's eyelashes, preferably in a uniform manner in as few steps as possible. To this end, the application portion of a typical mascara brush may be constructed to accomplish more than one function. For example, a desirable brush would be capable of picking up and transporting a supply of mascara from a reservoir and depositing it on a user's eyelashes. Bristles that are more flexible are thought to be better suited for the purposes of transport and application. A desirable brush would also be capable of combing out clumps of excess mascara and separating lashes so that the need for a separate combing tool and a separate combing step are eliminated. Stiffer bristles are thought to be better suited for the purposes of combing and separating.

Brushes capable of accomplishing to a degree both application and combing have been achieved by mixing bristles having different characteristics in a single bristle head, or, in a brush having one bristle type throughout the bristle head, by compromising the characteristics of individual bristles. An example of a brush that is said to provide improved application and combing characteristics with mixed bristles is shown in U.S. Pat. No. 4,861,179 to Schrepf et al., which discloses a brush having a combination of soft bristles and stiff bristles. An example of a brush said to provide improved application and combing characteristics with uniform bristles throughout the bristle head is shown in U.S. Pat. No. 5,238,011 to Gueret, which discloses bristles of what is said to be a larger than typical diameter made of what is said to be a softer than typical material (shore hardness of 20A to 40D). Each of the foregoing examples is of a brush of typical twisted wire construction.

It is believed that further improved results in mascara application can be achieved by forming applicators with clustered bristle characteristics, i.e., bristle characteristics that vary at regular intervals along the length of the brush. Preferably, groups of bristles, each group suited for a particular purpose or purposes, can be arranged in alternating or consecutive order along the length of the brush. For example, a brush could be formed with groups of two types of bristles, e.g., one type for application and one type for combing, the two groups alternating along the length of the brush. The arrangement would yield a brush with alternating sections, each capable of maximum performance for a particular function, thus improving the overall performance of the brush.

A typical mascara brush is comprised of a core formed from a single metallic wire folded in a generally u-shaped configuration to provide a pair of parallel wire segments. Bristles (also referred to as filaments or fibers), usually comprised of strands of nylon, are disposed between a portion of a length of the wire segments. The wire segments are then twisted, or rotated, about each other to form a helical core (also known as a twisted wire core) which holds the filaments substantially at their midpoints so as to clamp them. In this way, a bristle portion or bristle head is formed with radially extending bristles secured in the twisted wire core in a helical or spiral manner. See, for example, U.S. Pat. No. 4,887,622 to Gueret, and U.S. Pat. No. 4,733,425 to Hartel et al. This construction method is well suited to forming a typical bristle type of applicator (i.e., a twisted wire core brush) having uniform bristle characteristics along the length of the brush. However, it is not well suited for consistently forming brushes with bristle characteristics that vary at regular intervals along the length of the brush.

A mascara applicator having one or more beads secured to a central axis is disclosed in U.S. Pat. No. 5,816,728 to Nardollilo et al. A mascara applicator having an array of disk-like rings is disclosed in U.S. Pat. No. 4,411,282 to Wavering. However, neither reference discloses bristles or fibers extending from an applicator surface. In addition, the Wavering reference appears to disclose an array that is formed as a single unit, not as individual annular members formed separately from one another.

Flocked applicators are also known. For example, an applicator having bristles secured to and extending from a ribbed flexer is disclosed in U.S. Pat. Nos. 4,527,575 and 4,404,977 to Vasas. Each rib of the flexer is said to be in the form of an annular disk, however, like the array disclosed by Wavering, the flexer disclosed by Vasas appears to be formed as a single unit, not as separate disks or annular members. U.S. Pat. No. 3,998,235 to Kingsford discloses a cosmetic applicator having a plurality of axially spaced coating surfaces treated with flocked fibers. The plurality of axially spaced coating surfaces appears to be formed as a single unit. One limitation common to the manufacture of flocked items is that, without great care or great expense, a single item cannot readily be flocked with adjacent sections of fibers, each section having fibers with different characteristics. Thus, the applicators disclosed in the Wavering, Vasas and Kingsford references would not be readily adaptable to have adjacent sections of bristles with different characteristics, or to have bristle characteristics that vary at regular intervals along the length of the applicator. Accordingly, there is a need for a mascara applicator that has varying bristle characteristics, and in particular a flocked applicator with bristle characteristics that vary at regular intervals along the length of the applicator.

BRIEF SUMMARY OF THE INVENTION

In accordance with the present invention, a brush-type cosmetics applicator is provided that has bristles (also referred to herein as fibers or filaments) arranged such that application characteristics vary at regular intervals along the length of the applicator. A plurality of annular members (e.g., disks, sleeves, rings, beads, etc.) are each individually formed by, for example, molding. Each annular member has a central bore. At least some of the plurality of annual members (i.e., a first group of the annular members) is flocked, preferably on an outwardly directed surface, with fibers (i.e., bristles) of a desired diameter, hardness (as measured, for example, with a durometer), flexibility, length and composition (material). Each of a second group of the annular members is flocked with fibers having one or more characteristics different from the fibers used on the first group, e.g., a different diameter, hardness, flexibility, length or composition, or a combination thereof. Alternatively, each annular member of the second group may not be flocked, or may be flocked on a surface different from the surface flocked on each annular member of the first group (e.g., an axially directed surface). As another alternative, each annular member of the second group, whether flocked with the same fibers or different fibers, or not flocked, may have a radial or axial dimension that is different from the annular members of the first group. Annular members from each group are then arranged consecutively (i.e., "stacked") by way of the bore in each annular member on a shaft or pin to form the applicator portion of an applicator. The annular members are arranged in sequences that yield the desired applicator characteristics. For example, annular members from the first group provided with long bristles can be alternated with annular members from the second group provided with shorter bristles to form a brush-type applicator with improved coating and combing abilities.

DETAILED DESCRIPTION OF THE INVENTION

Figure 1:
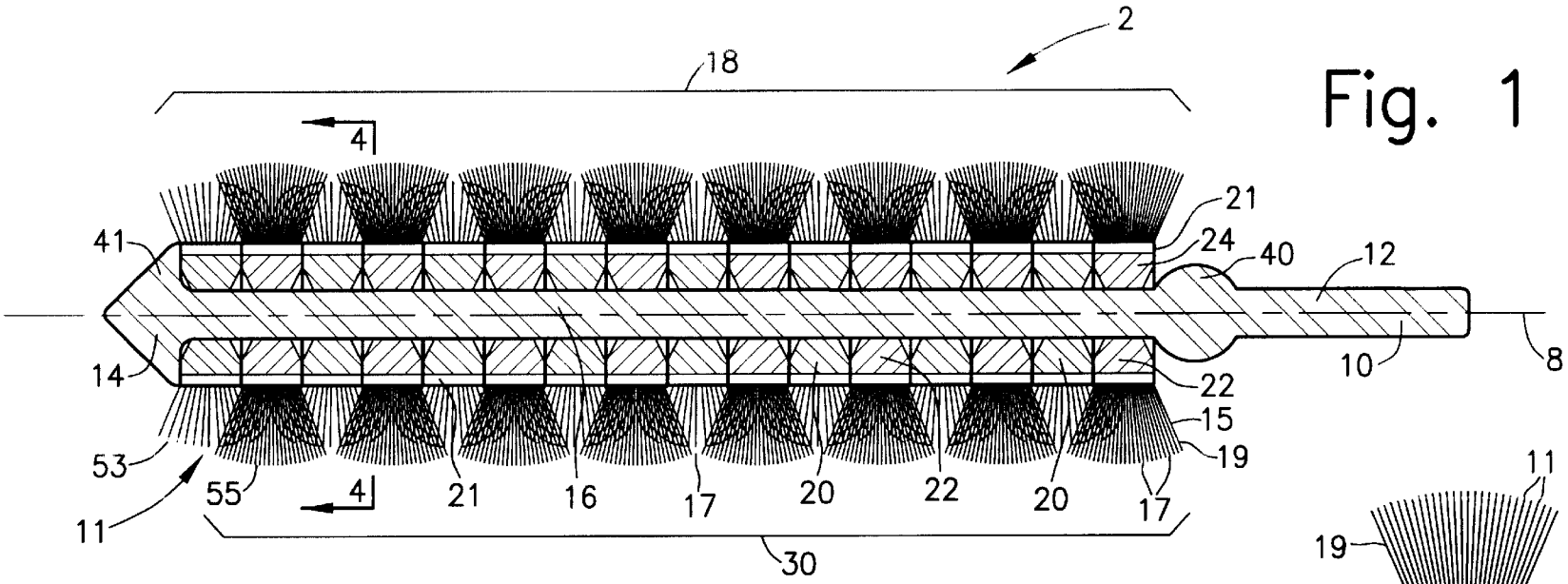
FIG. 1 is a sectional side elevation view of a brush-type cosmetics applicator according to the invention.

A brush-type applicator for applying a cosmetic product to hair or lashes is shown generally at 2 in FIG. 1. The applicator 2 is comprised of an elongate shaft 10 (also see FIGS. 5 and 6) having a proximal end 12, also referred to herein as a handle end, and a distal end 14 opposite the handle end 12. The shaft 10 has a longitudinal axis 8 defined through the handle end 12 and distal end 14. The proximal or handle end 12 of the shaft 10 may serve as a handle for manipulating the applicator 2. More commonly, the proximal end 12 of the shaft 10 is connected to a handle (not shown) or a cap-handle combination (not shown) similar to those shown, for example, in U.S. Pat. No. 4,411,282 to Wavering and U.S. Pat. No. 4,527,575 to Vasas, each herein incorporated by reference in its entirety. The Wavering and Vasas references each also show an example of the type of cosmetic package in connection with which the present applicator would typically be used. These types of cosmetic packages, i.e., a container in combination with an applicator provided on the end of a shaft secured to a cap-handle, and the methods for making them are well known in the art.

A distal portion of the shaft 10 extending from the distal end 14 toward the handle end 12 is referred to herein as the applicator end 16. The applicator end 16 of the shaft 10 is dimensioned and adapted to support brush-type applicator means 18 for coating, separating and combing hair or lashes. The brush-type applicator means 18 of the present applicator 2 is unique in that it is comprised of an array 30 of at least two annular members 20, 22. Each annular member 20, 22 is separately formed as a unit, and each is individually disposed on the shaft 10 to form the array 30 such that desired applicator qualities are achieved. Each annular member 20, 22 may be the same as the other, or differ from the other in one or more characteristics, discussed in greater detail below. The characteristics of the applicator along its length can be pre-determined by carefully selecting the characteristics of each of the annular members 20, 22, and carefully selecting the position of each of the annular members 20, 22 in the array 30.

The plurality of annular members 20, 22 forming the array 30 should comprise at least a first annular member 20 and a second annular member 22. The applicator depicted in FIG. 1 is shown with eight first annular members 20 and eight second annular members 22. However, these numbers are merely illustrative and it will be understood that the number of annular members 20, 22 comprising the entire plurality can vary substantially depending on, for example, the dimension of each annular member along the axis 8, the length along the axis 8 of the applicator end 16. It will also be understood that, although the applicator is shown and described with an array 30 having at least two different types of annular members, e.g., for illustrative purposes, the first annular members 20 having shorter bristles and the second annular members 22 having longer bristles, the array 30 may have only one type of annular member (i.e., the annular members 20, 22 may be identical), or the array 30 may have more than two types of annular members.

Figure 7:
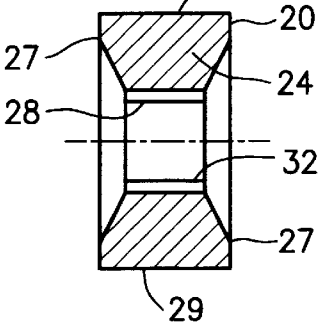
FIG. 7 is a sectional view of an individual annular member before fibers are attached.
Figure 9D:
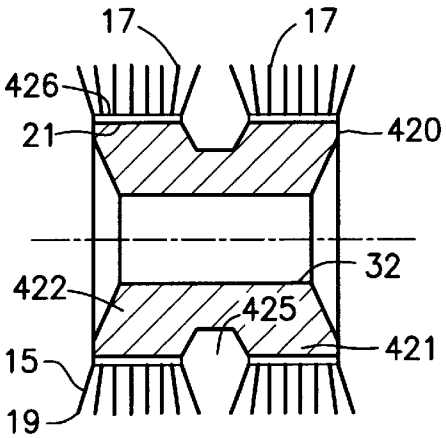
FIGS. 9*a*–9*d* are sectional views of alternative embodiments of individual annular members with fibers attached.
Figure 9C:
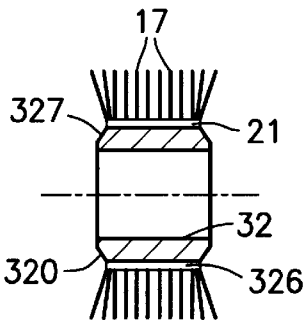
Figure 8:
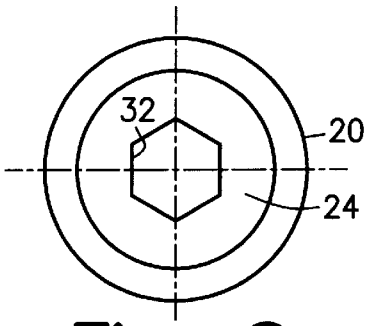
FIG. 8 is side elevation view of the individual annular member of FIG. 7.
Figure 9B:
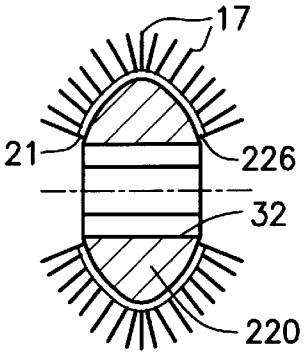
Figure 9A:
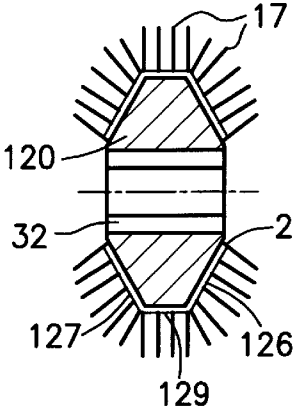

Each annular member 20, 22 may take the form of a disk, a ring, a sleeve, a bead, or a like form (see 20 in FIGS. 3, 4, 7, 8, and examples of alternative annular members 120, 220, 320, 420 in FIGS. 9*a*–9*d*). Each annular member has a body 24 with an outer surface 26. As shown in FIG. 7, the outer surface 26 may include a radially outwardly directed portion 29 (i.e., the cylindrical outer circumferential wall of the annular member) and lateral portions 27 (i.e., the opposite side walls of the annular member), and may include inwardly directed portion 28 (i.e., the inwardly directed surface of bore 32). It will be clear from the examples provided by the sectional views of the preferred embodiment in FIGS. 3 and 7, and the alternative embodiments shown in FIGS. 9*a*–9*d*, that the individual annular members 20, 120, 220, 320, 420 and corresponding outer surfaces 26, 126, 226, 326, 426 may take a variety of forms. For example, outer surface 126 in FIG. 9*a* is beveled, with a lateral portion 127 intersecting radially outwardly directed portion 129 at an angle. The lateral portion 127 is provided with fibers 17. In FIG. 9*b*, outer surface 226 is curved to form a bead-like annular member 220. In FIG. 9*c*, outer surface 326 is beveled, but lateral portion 327 is free of fibers, such that a fiber free clearance is formed when two annular members 320 are positioned adjacent to each other on the shaft 10. As shown in FIG. 9*d*, by providing outer surface 426 with an annular clearance or groove 425, sleeve-like annular member 420 appears to be formed from two disk-like portions 421, 422. The clearance 425 may facilitate product loading on the applicator.

Figure 3:
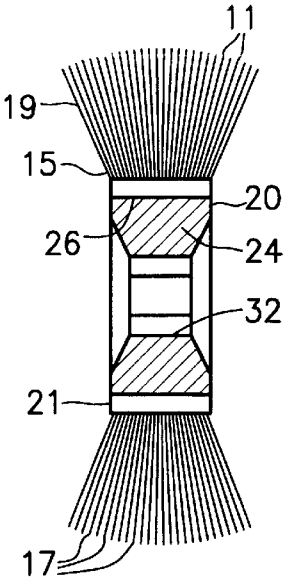
FIG. 3 is a sectional view of an individual annular member with fibers attached according to the present invention.
Figure 4:
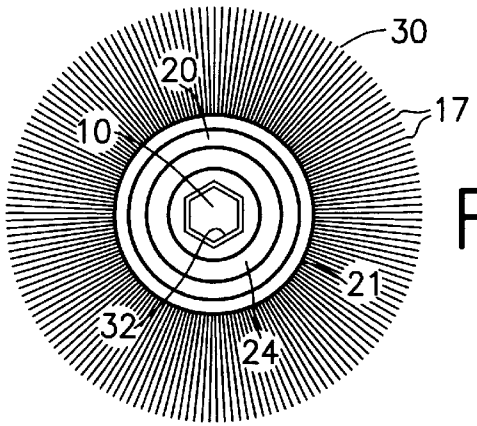
FIG. 4 is sectional view of the applicator taken along sectional line 4—4 in FIG. 1.
Figure 2:
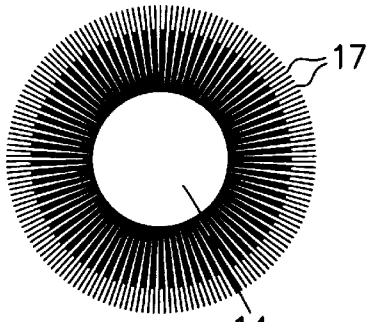
FIG. 2 is an end elevation view of the applicator of FIG. 1.
Figure 5:
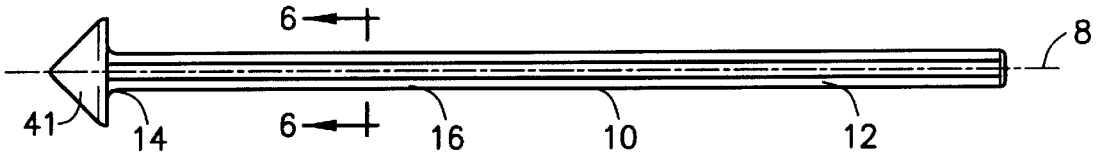
FIG. 5 is a side elevation view of a shaft of the applicator of FIG. 1.
Figure 6:
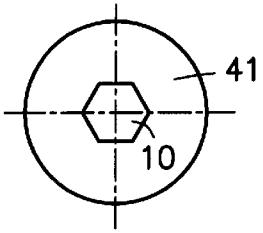
FIG. 6 is a sectional view of the shaft taken along sectional line 6—6 in FIG. 5.

As noted above, the body 24 defines a bore 32 dimensioned to be received closely on the shaft 10. The bore 32 and the shaft 10 may be configured such that the annular member 20, 22 rotates freely on the shaft 10. Alternatively, the bore 32, as shown in FIGS. 3, 4, 7 and 8, and the shaft 10, as shown in FIGS. 4, 5 and 10 may be cooperatively indexed to prevent the annular members 20, 22 from rotating on the shaft. As illustrated, the bore 32 has a hexagonal cross-section that corresponds in shape and dimension to the hexagonal cross-section of the shaft 10 (see FIG. 6). The corresponding cross-sections of the bore 32 and the shaft 10 prevent the annular members 20, 22 from rotating relative to the shaft 10. It will be understood that cross-sectional shapes other than the hexagonal shape shown can be used to index the annular members relative to the shaft, e.g., a square (not shown), a star (not shown), a key and channel (not shown), or the like. The body 24 of each annular member 20, 22 is preferably radially symmetrical (e.g., round, oval), with the bore 32 centered in the body 24, such that when the annular members 20, 22 are in place on the shaft 10, the array 30 will be radially symmetrical about the longitudinal axis 8. Alternatively, the body 24 of some or all of the annular members 20, 22 may be eccentrically shaped (e.g., ovoid), or may have the bore 32 offset from a central position in the body, such that all or portions of the array 30 will be radially eccentric relative to the longitudinal axis 8.

The shaft 10 and each annular member 20, 22 is made from a suitable well known material, such as, for example, POM (acetal), and by a well known method, such as, for example, molding. Other suitable materials for the shaft 10 and the annular members 20, 22 may include metals, such as, for example, aluminum, carbon steel and stainless steel, or plastics and/or resins, such as, for example, styrene, polyethylene (including HDPE and LDPE), polypropylene (including PP), nylon, polyvinyl chloride, polyethylene terephtalate, polycarbonate, acrylic, and the like.

To provide the applicator with brush-like qualities, a plurality of fibers 17 (also referred to herein as bristles or filaments) may be added to at least some of the annular members 20, 22. The fibers 17 significantly enhance the product loading, wiping and application characteristics, and the separation and combing characteristics of the array 30. The fibers 17 are preferably made of nylon, although the use of fibers made from other suitable materials, either natural or synthetic, is contemplated. For example, fibers made from plastic or rubber materials may be used, including, but not limited to, fibers made from acrylic, polyester, and rayon. The fibers may vary in length from about 0.25 mm to about 6.25 mm in length, depending on size of the supporting annular member and the desired application or combing characteristic(s) to be achieved. Each fiber 17 is attached by a first end 15 to the outer surface 26 of the annular member 20 or 22. An opposite free end 19 of each fiber 17 is spaced apart from the outer surface 26, such that each fiber extends outwardly away from the surface 26. Preferably, the fibers 17 are attached to the outer surface 26 such that, when the annular members 20, 22 are mounted on the shaft 10, the fibers 17 generally extend radially outwardly relative to the longitudinal axis 8 of the shaft 10. However, it is contemplated that for certain applications, it may be desirable to attach fibers 17 to portions of the outer surface 26 such that, when the annular members 20, 22 are mounted on the shaft 10, the fibers 17 are directed substantially along the longitudinal axis 8 of the shaft 10 (see FIGS. 9*a* and 9*b*). When the annular members are provided consecutively in close, adjacent proximity on the shaft, fibers of adjacent annular members may intermingle as shown at the area indicated by arrow 11 in FIG. 1.

The fibers 17 may be attached to the annular members 20, 22 by adhesive or other suitable means. This can be accomplished by a suitable flocking process such as, for example, mechanical, electrostatic or wet dispersion flocking. A suitable flocking process is described, for example, in U.S. Pat. No. 4,527,575 to Vasas, incorporated herein by reference. An adhesive is coated onto selected portions of the outer surface 26 of the annular members 20, 22 to form an adhesive layer 21. The adhesive comprising adhesive layer 21 should be selected for compatibility with the material of the fibers 17, the material of the annular members 20, 22 and the material (e.g., cosmetic) that the applicator is intended to transport and apply. The adhesive should upon curing be capable of permanently securing the selected fibers 17 to the material of the annular members 20, 22. Before the adhesive layer 21 cures, fibers having suitable characteristics (e.g., length, hardness, flexibility, thickness, product compatibility, etc.), are provided to the adhesive layer 21 such that the first end 15 of each contacts and sticks to the adhesive layer 21. This can be accomplished, for example, by electrostatically charging each fiber 17, and subsequently providing each fiber 17 to the adhesive layer 21 by way of an electrical field that aligns the first end 15 of each fiber such that it contacts the adhesive layer 21. When the adhesive cures, the first end 15 of each fiber 17 is securely anchored to the annular member 20, 22 in the adhesive layer 21. Alternatively, to avoid the use of adhesives, the flocking process can be integrated into the production process for the annular members 20, 22 by providing the electrostatically charged fibers to selected surfaces of an annular member before that selected surface of the annular member is fully cured. Subsequent curing of the component surface will anchor the fibers perpendicularly in the surface. In any case, the selected surface portions of each annular member 20, 22 are flocked before the array 30 is assembled on the shaft 10.

In a preferred embodiment shown in FIG. 1, annular members 20 are provided with shorter bristles 53, and annular members 22 are provided with longer bristles 55. However, the length of the bristles on each of the annular members 20, 22 may be the same, because the bristles or annular members may vary in other ways, as explained elsewhere herein.

As noted, the fibers may be applied to any selected portion of the outer surface 26, e.g., the perimeter of the annular member (radially outwardly directed portion 29), the side wall surfaces of the annular member (lateral portions 27), or even the inwardly directed surface 28 of the bore 32. Referring to FIGS. 3, 4 and 9, flocked fibers 17 are shown in exemplary configurations on the annular members 20, 120, 220, 320 and 420.

As noted above, each annular member 20, 22 is formed separately and apart from the applicator shaft, selectively provided with fibers 17 and subsequently individually and consecutively disposed about the shaft 10 at the applicator end 16 by way of the bore 32. The array 30 of annular members 20, 22 is secured to the shaft 10 by one of several methods. Each annular member 20, 22 of the array 30 may be individually secured to the shaft by, for example, interference fit, adhesive, sonic welding, or other well known attaching methods or means. Alternatively, a first stop 40 and a second stop 41 is provided for retaining the array 30 of annular members on the applicator end 16 of the shaft 10. The first stop 40 is located at the proximal end of the array 30 and the second stop 41 is located at the distal end 14 of the shaft 10. The first stop 40 and the second stop 41 define an area on the shaft 10 within which axial movement of the array 30 of annular members is restricted. The first stop and the second stop can be any physical structure that creates a barrier to axial movement of an annular member 20, 22 along the shaft 10. For example, as depicted in FIG. 1, the shaft 10 can be provided with enlarged diameter portions, or stops 40, 41. The distal stop 41 is molded as part of the shaft 10. The proximal stop 40 is a mechanically or heat deformed portion of the shaft 10, also known as a staking crimp. Alternatively, the stops can be provided by fixedly securing one or both of the first and last annular members of an array 30 to the shaft 10 by, for example, adhesion, snap fit, interference fit, cooperating threads, etc. While at least one of the stops 40, 41 can be provided to the shaft 10 during formation of the shaft, the other stop will need to be fixed to the shaft after the array 30 of annular members 20, 22 has been positioned on the shaft. This can be accomplished, for example, by making the other stop a separate piece that can be fastened to the rod after the array 30 is in place on the shaft, or by mechanically deforming a portion of the shaft after the array 30 is in place.

As noted above, two or more annular members 20,22 are disposed consecutively, in close, adjacent proximity on the shaft along the applicator end 16 to form the array 30. To assemble an applicator with particular characteristics, annular members 20 can be selected having fibers 53 made of a first material and having a hardness (as measured, for example, with a durometer), a flexibility, a diameter and a length, and annular members 22 can be selected having fibers 55 that differ from the fibers 53 on the annular members 20 by one of the material, the hardness, the flexibility, the diameter or the length. Alternatively, the fibers 53, 55 on annular members 20 and 22 may be identical, while one of the shape, the radial dimension or the axial dimension of the body 24 of each of annular members 20 differs from that of annular members 22. The annular members 20, 22 having different fibers and/or dimensions are then assembled on shaft 10 to form an array 30 providing pre-determined application, combing, loading or other characteristics. The annular members 20, 22 having different fibers and/or dimensions may be alternated along the array 30 as shown in FIG. 1, or may be provided in other sequences that yield the desired applicator characteristics.

One group of annular members can also be distinguished from another group of annular members by being free of fibers. This can be particularly useful where the intermingling fibers of adjacent flocked annular members yields overly crowded fiber zones (11). Flocked annular members can be spaced apart by inserting a spacer ring or an annular member that is free of fibers. In fact, for certain application purposes, providing annular members in the array that are free of fibers may be preferable to having all of the annular members in the array provided with fibers.

To make the brush-like applicator described above, at least a first annular member 20 and a second annular member 22, each having a bore 32 and a supporting surface 26, are formed. A first plurality of individual fibers 53 is attached to the supporting surface 26 of at least the first annular member 20. Each of the individual fibers is attached to the mounting surface by one end 15 and has a free end 19 spaced apart from the mounting surface 26. A shaft 10 dimensioned to receive the annular members 20, 22 by way of the bore 32 is provided. The first and second annular members 20, 22 are positioned and secured on the shaft.

As an example of a preferred embodiment, a brush-like applicator 2 having the following dimensions is contemplated. A shaft 10 is formed from POM (acetal) by injection molding. The shaft 10 has a length from the proximal or handle end 12 to the distal end 14 (including the applicator end 16 of the shaft) of 39.9 mm. The shaft 10 has an octagonal cross-section with a maximum cross-sectional dimension (measured from corner-to-corner across the octagonal section) of just under 1.2 mm. The applicator end 16 of the shaft 10, i.e., the portion supporting flocked annular members 20, 22, is approximately 26.5 mm long. The 26.5 mm dimension is sufficiently long to support consecutively sixteen 1.5 mm wide annular members, a proximal stop 40 and a distal stop 41. The distal stop 41 is molded as an integral part of the shaft 10 and has a diameter of 3.5 mm. The distal stop 41 tapers in a distal direction to a blunt end. The proximal stop 40 is provided to the shaft 10 by mechanical or heat deformation of a portion of the shaft 10 after the complete array of annular members 20, 22 are positioned on the shaft.

Sixteen annular members 20, 22 are individually formed by injection molding from POM (acetal). In the embodiment shown, each of the annular members has a body 24 with identical dimensions. A centrally located octagonal cross-section bore 32 is provided in the body 24 and is dimensioned to be received on the applicator end 16 of the shaft 10, i.e., the bore has an inside dimension across the corners of the octagonal cross-section of 1.2 mm or slightly larger. The body 24 of each annular member 20, 22 is disk-like with a diameter of 3 mm and a width of 1.5 mm. Thus, the disk-like body defines a 1.5 mm wide cylindrical surface 29 (like the edge of a coin).

An adhesive suitable for permanently securing nylon fibers to POM plastic (e.g., an epoxy) is provided in a layer 21 applied to the cylindrical surface 29 of each of a first group of eight annular members (annular members 20). Before the adhesive cures, fibers 53 are deposited by well known flocking methods such that one end 15 of each fiber is embedded in the adhesive layer 21 and thereby attached to the surface 29, while an opposite end 19 extends away from the surface 29. The fibers 53 are relatively shorter (about 1.25 mm), softer fibers to yield an overall outside diameter for each of this group of annular members of 5.5 mm. Similarly, adhesive is applied in a layer 21 to the cylindrical surface 29 of a second group of annular members (annular members 22), and fibers 55 are deposited by flocking such that each is embedded by one end 15 in the adhesive. The fibers 55 are relatively longer (about 2.25 mm), stiffer fibers yielding an overall outside diameter of 7.5 mm for each of the eight annular members 22 of the second group.

The free ends 19 of the extending fibers 53, 55 of annular members of both the first and second group are splayed apart somewhat relative to each other and to the 1.5 mm width of the cylindrical surface to which the adhered ends 15 are attached. Accordingly, the splayed free ends 19 define an overall width of approximately 2.76 mm, substantially wider than the 1.5 mm width of the body 24 of each annular member 20, 22.

After the sixteen annular members 20, 22 are formed and flocked in two groups of eight (eight with longer, stiffer fibers and eight with shorter, softer fibers), they are installed on the shaft 10 by sliding them consecutively over the handle end 12 onto the applicator end 16. Annular members 22 having longer, stiffer bristles are alternated along the length of the shaft 10 with annular members 20 having shorter, softer fibers. Each annular member 20, 22 is positioned in close adjacent proximity to the next annular member 20, 22, so that little or no space is provided between adjacent members. Since there is little or no space between adjacent annular members 20, 22, the free ends 19 of oppositely splayed fibers 53, 55 of adjacent annular members intermingle in the zone indicated by arrow 11. After all sixteen of the annular members 20, 22 are properly positioned on the shaft 10, the proximal stop 40 is provided to the shaft 10 by mechanical or heat deformation of a portion of the shaft.

With the foregoing structural arrangement and method of assembly, a manufacturer of applicators need only produce and stock a limited number of annular member types, from which a large variety of applicator types, each having different application characteristics, can be assembled merely by varying the combinations and/or sequence of the annular members forming the array.

While the invention has been described and illustrated as embodied in preferred forms of construction, it will be understood that various modifications may be made in the structure and arrangement of the parts without departing from the spirit and the scope of the invention recited in the following claims.

What is claimed is:

1. An applicator for applying a cosmetic product to hair or lashes, the applicator comprising:

an elongate shaft having a handle end and an applicator end, and a longitudinal axis defined from the handle end through the applicator end;

an array having at least a first annular member and a second annular member, each of said annular members being formed separately and having a central bore through which each annular member is disposed alone a length of the shaft at the applicator end, each annular member made of a material and having a radial dimension and an axial dimension; and a first plurality of fibers each of which is made of a material and has a hardness, a flexibility, a diameter and a length, each of which is attached to a surface of the first annular member by a first end and each of which has an opposite free end spaced apart from the surface of the first annular member.

2. The applicator of claim 1 wherein the fibers are attached to the surface by adhesion.

3. The applicator of claim 1 wherein each of the material, the radial dimension and the axial dimension of the first annular member is the same as each of the material, the radial dimension and the axial dimension of the second annular member.

4. The applicator of claim 1 wherein the first annular member differs from the second annular member by at least one of the material, the radial dimension and the axial dimension.

5. The applicator of claim 1 wherein the shaft further comprises a proximal stop and a distal stop, and the array is provided between the stops to restrict axial movement of the array.

6. The applicator of claim 1 wherein the shaft and the bore of at least one of the first annular member and the second annular member are cooperatively indexed to prevent the at least one of the first annular member and the second annular member from rotating on the shaft.

7. The applicator of claim 1 further comprising a second plurality of fibers each of which is made of a material and has a hardness, a flexibility, a diameter and a length, each of which is attached to a surface of the second annular member by a first end and each of which has an opposite free end spaced apart from the surface of the second annular member.

8. The applicator of claim 7 wherein each of the material, the radial dimension and the axial dimension of the first annular member is the same as each of the material, the radial dimension and the axial dimension of the second annular member.

9. The applicator of claim 7 wherein the first annular member differs from the second annular member by at least one of the material, the radial dimension and the axial dimension.

10. The applicator of claim 7 wherein each of the material, the hardness, the flexibility, the diameter and the length of each fiber comprising the second plurality of fibers is the same as each fiber comprising the first plurality of fibers.

11. The applicator of claim 10 wherein each of t he material, the radial dimension and the axial dimension of the first annular member is the same as each of the material, the radial dimension and the axial dimension of the second annular member.

12. The applicator of claim 10 wherein, the first annular member differs from the second annular member by at least one of the material, the radial dimension and the axial dimension.

13. The applicator of claim 7 wherein each fiber comprising the second plurality of fibers differs from each fiber comprising the first plurality of fibers by at least one of the material, the hardness, the flexibility, the diameter and the length.

14. The applicator of claim 13 wherein each of the material, the radial dimension and the axial dimension of the first annular member is the same as each of the material, the radial dimension and the axial dimension of the second annular member.

15. The applicator of claim 13 wherein the first annular member differs from the second annular member by at least one of the material, the radial dimension and the axial dimension.

16. An applicator for applying a cosmetic product to hair or lashes, the applicator comprising:

an elongate shaft having a handle end and an applicator end, and a longitudinal axis defined from the handle end through the applicator end;

an array having at least a first annular member and second annular member, each of said annular members being formed separately and having a central bore through which each annular member is disposed along a length of the shaft at the applicator end; and a first plurality of fibers each made of a material and each having a hardness, a flexability, a diameter and a length, the first plurality of fibers attached to a surface of the first annular member by flocking.

17. The applicator of claim 16 further comprising a second plurality of fibers each made of a material and each having a hardness, a flexibility, a diameter and a length, the second plurality of fibers attached to a surface of the second annular member by flocking.

18. The applicator of claim 17 wherein the material, the hardness, the flexibility, the diameter and the length of fibers comprising the first plurality of fibers is substantially the same as the material, the hardness, the flexibility, the diameter and the length of fibers comprising the second plurality of fibers.

19. The applicator of claim 17 wherein fibers comprising the first plurality of fibers differ from fibers comprising the second plurality of fibers by at least one of the material, the hardness, the flexibility, the diameter and the length.

20. A method for making an applicator, the applicator having an array of annular members supported on an applicator end of a shaft opposite a handle end, the method comprising:

providing at least a first annular member and a second annular member, each annular member having a bore and a supporting surface;

attaching a first plurality of fibers to the supporting surface of the first annular member, substantially each of the fibers attached to the supporting surface by one end and having a free end extending away from the supporting surface; and mounting each of the first annular member and the second annular member by way of its respective bore consecutively on the applicator end of the shaft.

21. The method of claim 20 further comprising attaching a second plurality of fibers to the supporting surface of the second annular member, substantially each of the fibers attached to the supporting surface of the second annular member by one end and having a free end extending away from the supporting surface of the second annular member.

22. The method of claim 21 wherein fibers comprising the first plurality of fibers differ from fibers comprising the second plurality of fibers by at least one of a material, a hardness, a flexibility, a diameter and a length.

* * * * *